United States Patent [19]

Masuzawa et al.

[11] 4,338,490

[45] Jul. 6, 1982

[54] SPEECH SYNTHESIS METHOD AND DEVICE

[75] Inventors: Sigeaki Masuzawa; Hiroshi Miyazaki, both of Nara; Shinya Shibata, Yamatokoriyama, all of Japan

[73] Assignee: Sharp Kabushiki Kaisha, Osaka, Japan

[21] Appl. No.: 134,318

[22] Filed: Mar. 26, 1980

[30] Foreign Application Priority Data

Mar. 30, 1979 [JP] Japan ..... 54-39050
Mar. 30, 1979 [JP] Japan ..... 54-39054

[51] Int. Cl.[3] ..... G10L 1/00
[52] U.S. Cl. ..... 179/1 SM
[58] Field of Search ..... 179/1 SM, 1 SG; 364/513, 710; 340/148

[56] References Cited

U.S. PATENT DOCUMENTS 3,641,496 2/1972 Slavin ..... 179/1 SM X
3,704,345 11/1972 Coker et al. ..... 179/1 SM
3,908,085 9/1975 Gagnon ..... 179/1 SM
4,266,096 5/1981 Inoue et al. ..... 179/1 SM

*Primary Examiner*—Mark E. Nusbaum
*Assistant Examiner*—E. S. Kemeny
*Attorney, Agent, or Firm*—Birch, Stewart, Kolasch & Birch

[57] ABSTRACT

A speech synthesis device is adapted to provide an audible indication of numerical information through the utilization of a predetermined number of phonemes. Those phonemes are stored within a read only memory on a single large scale integrated circuit chip. A desired length of pause or silence is provided depending upon the kind and location of information to be audibly outputted. The necessity for the pause period is stored in digitally encoded signals within the read only memory in the same manner as with the phonemes.

3 Claims, 6 Drawing Figures

SPEECH SYNTHESIS METHOD AND DEVICE

BACKGROUND OF THE INVENTION

This invention relates to a speech synthesis method and device for reproducing desirable sound information through the utilization of a number of phonemes.

It is generally known that several phonemes are used in combination to constitute numerical information in the form of an audible sound or synthesized voice in providing audible indications of numerical information. For instance, "2,534" (ni sen go hyaku san jyu yon in Japanese and its English version is two thousand, five hundred thirty four) may be audibly indicative of seven phonemes "ni", "sen", "go", "hyaku", "san", "jyu" and "yon." Accordingly, it is possible to provide an audible indication of numerical information by loading a necessary number of basic phonemes into a memory and fetching them in a given order from the memory for subsequent speech synthesis.

However, the results of our extensive researches reveal that a mere combination of those basic phonemes causes inconvenience for the listener's appreciation of audible indications as the case may be. It has also been found that in providing an audible indication of 12,300,450 (ni oku ni sen san byaku man yon sen go hyaku in Japanese and its English version is twelve million, three hundred thousand, four hundred and fifty), for example, a given period of silence or pause is needed immediately after "oku." Failure to locate such silence or pause period results in that the listener may hear the synthesized voices "oku" and "ni" very closely and face difficulty or eventually commit an error in dictating audible indications. This is also true of the spacing between "man" and "yon." It has also been made clear that a silence or pause period is necessary immediately before "hyaku" (hundred in English) and "jyu" (ten in English) in the case where numerical information bears "1" in hundred and must be pronounced in the form of only "hyaku" or bears "1" in tens and must be pronounced in only "jyu." For instance, such a silence or pause is required between "sen" and "hyaku" of "roku sen hyaku ni jyu" (its English version is six thousand, one hundred twenty) and between "jyu" and "hyaku" of "yon sen san byaku jyu ni" (its English version is four thousand, three hundred and twelve).

Furthermore, a silence period is needed just before an audible indication "ten" (its English version is "point") and, for example, between "ten" and "san" of "hyaku ni jyu san ten yon go (123.45)."

While the foregoing has set forth especially the situation where audible indications of numerical information accompany words indicative of respective units thereof, such silence or pause period is similarly required when audible indications are provided without unit information, for instance, before each three-digit punctuation and a decimal point: between, "ni" and "konma" of "ni konma san yon go konma roku nana hachi" (2,345.678) and between "san" and "ten" of "ichi ni san ten yon go" (123.45).

OBJECTS AND SUMMARY OF THE INVENTION

Accordingly, it is an object of the present invention to provide an improved speech synthesis method and device which eliminates the possibility of the listener's error in recognizing audible indications of numerical information by simulating human voices more naturally and closely through the use of an artificial provision of silence or pause of a given duration of time.

Briefly, according to the present invention there is provided a speech synthesis device comprising means for providing audible indications of information through the utilization of combinations of a plurality of phonemes and means for providing a desired length of silence or pause for said phonemes. In a preferred form of the present invention, the plurality of phonemes are stored in the form of coded digital signals within a solid state memory and preferably a read only memory and the silence or pause period is similarly stored within the memory in the form of specific coded digital signals.

BRIEF DESCRIPTION OF THE DRAWINGS

The foregoing as well as other objects, features and advantages of the present invention will become more readily appreciated upon a consideration of the following detailed description of the illustrated embodiments, together with the accompanying drawings, wherein.

DETAILED DESCRIPTION OF THE ILLUSTRATED EMBODIMENT

Figure 1:
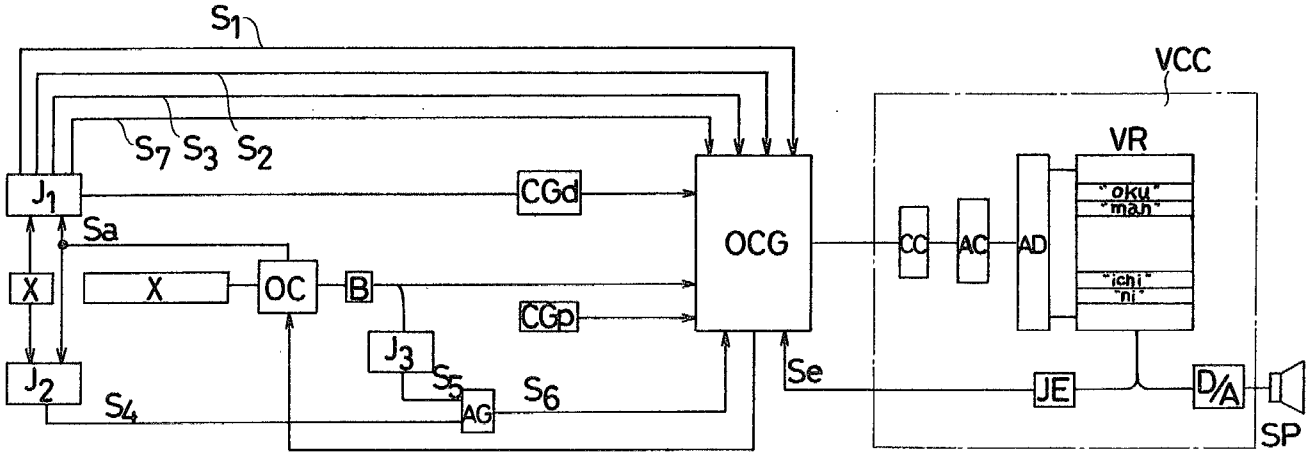
FIG. 1 is a schematic block diagram of a speech synthesis device constructed in accordance with one preferred form of the present invention.

Referring initially to FIG. 1, there is illustrated a speech synthesis device according to the present invention which includes a first register X storing numerical information and a second register x storing decimal point position information both of which is preferably implemented within a random access memory (RAM). An output control circuit OC fetches the contents of the X register in the order of audible indications to be outputted and supplies the fetched information to a one-digit buffer register B. Depending upon a signal Sa indicating the decimal point and what digit position the output control circuit OC derives the information from the X register, a unit decision circuit $J_1$ decides the unit of the information sent to the buffer register B and develops signals $S_3$, $S_2$ and $S_7$ when the information in the buffer is in either hundred millions or ten thousands, one place of decimals, or two or more places of decimals, respectively. Otherwise, the decision circuit $J_1$ develops a signal $S_1$. Similarly, a decision circuit $J_2$ is responsive to the signal Sa indicating the decimal point position and what digit position the output circuit OC derives the information from the X register and develops a signal $S_4$ when the information is in either hundred or tens. A decision circuit $J_3$ decides if the contents of the buffer B are "1" and develops an output signal $S_5$ if yes. An AND gate AG gates a signal $S_6$ to an output control section OCG when receiving the both of the signals $S_4$ and $S_5$.

A pair of code generators are labeled CGd and CGp with the former CGd encoding unit words such as "millions", "thousands" and and so on and the latter CGp developing codes indicative of a silence period. An output control section OCG supplies the outputs of CGd, CGp and B in a predetermined order in accordance with the signals $S_1$, $S_2$ and $S_3$.

A voice synthesizer circuit VCC provides sound outputs each corresponding to the codes developed from OCG. A code converter CC loads an initial address of the sound outputs corresponding to the output codes from OCG into an address counter AC. There are further provided a memory VR storing phonemes data, an address decoder AD and a digital-to-analog converter D/A. A detector JE senses an END code contained within the memory VR and provides its output signal Se. A loud speaker is labeled SP.

Assume now that the X register bears 254325678 and the x register bears 0, thus storing "ni oku go sen yon hyaku san jyu ni man go sen ro hyaku nana jyu hachi" (its English version is two hundred and fifty-four million, three hundred and twenty-five thousand, six hundred and seventy-eight) as a whole. In fetching information in hundred millions for the buffer B, the decision circuit $J_1$ develops the signal $S_3$ so that OCG permits the contents of the buffer B to be unloaded into VCC to develop a sounded voice "ni." Upon the completion of the sound "ni" OCG receives the signal Se and transfers the output codes from CGd into VCC. Since under these circumstances CGd develops the codes indicative of "oku" (its English equivalent is hundred millions) are being developed from CGd, VCC produces a synthesized voice "oku." After that, the voice end signal Se is received so that CGp provides its output indicative of the silence period for VCC. Upon the receipt of this output code VCC develops a silence period for a given length of time, thus locating the silence period immediately after the delivery of the unit word "oku." Subsequently, OC feeds information in the next descending unit "tens millions" to the buffer B. $J_1$ develops the signal $S_1$ and OCG transfers the contents of B into VCC for the delivery of a sound "go." CGd then sends the codes of "sen" (its English equivalent is thousand) to VCC which in turn delivers a sound "sen." Similarly, the information in millions is sent to the buffer B, thus producing sounds "yon" and "hyaku."

Through the above discussed operation a string of the sounds are delivered. When OC transfers the contents of the X register in tens thousands into the buffer B, $J_1$ develops the signal $S_3$. The output control section OCG sends (1) the contents of the buffer B, (2) the output codes from CGd and (3) the output codes from CGp in the named order to VCC. This sequence of operation locates a prefixed length of silence immediately after "man."

When the X register bears 3245 and the x register bears 2, the both store "32.45" as a whole. In this case $J_1$ develops the signal $S_1$ and OCG transfers (1) the contents of the buffer B and (2) the output code from CGd in the named order into VCC to thereby reproduce sounds "san" and "jyu."

With respect to the information in units, $J_1$ develops the signal $S_1$ and OCG sends (1) the contents of the buffer B and (2) the output codes of CGd in the named order to VCC. Since CGd develops not unit codes such as "man", "oku" and "sen", only a sound "ni" is developed. When one place of decimals is introduced into the buffer B, $J_1$ develops the signal $S_2$ so that OCG unloads (1) the output codes of CGp, (2) the output codes of CGd and (3) the contents of the buffer B in the named order into VCC. This locates a given length of silence before "ten" intermediate "ten" and "yon". The contents in the second place of decimals is thereafter introduced into the buffer B, allowing $J_1$ to develop the signal $S_7$. In response to this signal OCG unloads only the output buffer B into VCC. In this manner, the sounds "san jyu ni ten yon go" are delivered.

It is now assumed that the X register bears "6125" and the x register bears "0", thus storing together "6125." When the information in hundred enters the buffer B, $J_2$ develops the signal $S_4$ while $J_3$ senses that the contents of B are "1" and thus develops $S_5$. For this reason the signal $S_6$ is sent to OCG which in turn sends (1) the output codes of CGp and (2) the output codes of CGd in the named order to VCC. This locates a predetermined length of silence just before "hyaku." In the case that the tenth-digit information bears "1" like 3210, the signals $S_4$ and $S_5$ are also developed to thereby locate a silence period just before "jyu."

Figure 3:
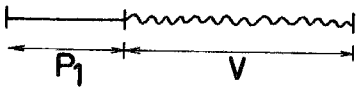
FIGS. 3(*a*) through 3(*c*) show the relationship between silence periods and voice periods associated with respective phonemes.
Figure 3:
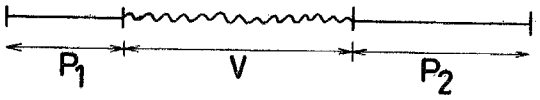
Figure 3:
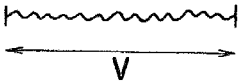
Figure 4:
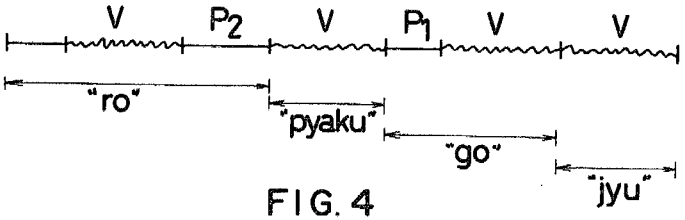
FIG. 4 shows the relationship between the silence and voice periods when numerical information "650" (ro pyaku go jyu) is simulated.

As noted earlier, the predetermined length of silence or pause is especially provided before "oku" and "man" and also immediately before "hyaku" and "jyu" when the information in hundred and tens, respectively, bears "1" as well as before "ten" indicative of decimals. In FIG. 3(*a*), there are located the silence period $P_1$ and the voice period v in the case that audible outputs are numerical such as "ichi", "ni", "san", "yon" etc. or decimals "ten." Similarly, FIG. 3(*b*) illustrates the provision of the silence periods $P_1$ and $P_2$ and the voice period v when double consonants are to be pronounced, for example, "ĭ", "hă" and "rŏ" in "ĭ ten zero" (1.0), "ĭ sen" (1000), "hă ten zero" (8.0), "hă pyaku" (800), "hă sen" (8000) and "rŏ hyaku" (600), while FIG. 3(*c*) shows no silence period when punctual words are to be announced. In this manner, the silence period is located depending upon the kind of the words to be announced. For instance, when it is desired to announce "rŏ hyaku go jyu (650)", "rŏ" is provided as a double consonant by virtue of the location of the silence period $P_2$ and "rŏ hyaku" and "go jyu" are slightly separated by the provision of the silence period $P_1$.

Figure 2:
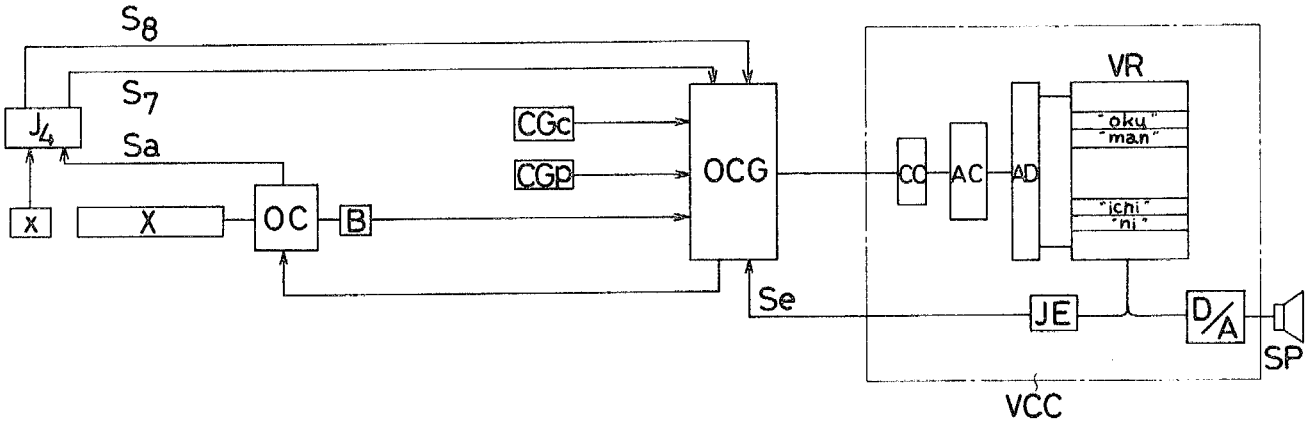
FIG. 2 is a schematic block diagram showing another preferred form of the present invention.

FIG. 2 shows another preferred embodiment of the present invention in which audible indications accompany no sounds indicative of respective units and the same components are designated by the same reference numbers as used in FIG. 1. An additional decision circuit $J_4$ decides if the buffer B assumes a punctuating mark or decimal points and develops a signal $S_8$ if so. Otherwise, it produces a signal $S_7$. In response to the signal $S_8$, OCG sends (1) the output codes of CGp, (2) the output codes of CGc and (3) the contents of the buffer B in the named order to VCC. When the signal $S_7$ is received, only the contents of the buffer B are shifted into VCC. The code generator CGc generates codes indicative of "punctuating mark" or "decimal."

For instance, the X register stores "123456789" and the x register stores "2", thus storing together "1,234,567.89." The silence period is located between "ichi" and "konma (punctuating mark)" and between "yon" and "konma." The silence is also located between "nana" and "ten."

Although the same length of silence is provided in the above illustrated embodiments, it is obvious that the present invention should not be limited thereto and it is possible to vary the length of the silence period depending on the kind and location of information to be audibly outputted. It is also possible to store the necessity for the silence period together with its associated phonemes, for example, "oku plus silence" and "man plus silence", thus avoiding the particular circuit arrangement for inserting the silence period.

While specific embodiments have been illustrated and described herein the invention is not limited thereto. On the cotrary, various modifications, changes and alternatives may occur to those skilled in the art, and the invention includes such changes, modifications and alternatives insofar as they fall within the spirit and scope of the appended claims.

We claim:

1. A synthetic speech device capable of developing audible sounds indicative of numerical data and capable of inserting pause intervals at desired locations within said audible sounds, comprising:

first means for storing said numerical data therein and for storing information indicative of the location of the decimal point within said numerical data;

second means for storing said numerical data therein and developing output signals indicative thereof;

third means interconnected between the first and second means for transferring said numerical data from the first means to the second means;

decision means connected to the first means and third means for determining the digit positions of the numerical data transferred from the first means to the second means relative to the location of the decimal point within said numerical data and developing output signals indicative of the digit positions;

pause code storage means for storing codes indicative of said pause intervals and developing output signals indicative thereof;

control means connected to the pause code storage means, to the decision means, and to the second means and responsive to the output signals delivered therefrom for correlating and synthesizing the numerical data stored in the second means with the digit positions of said numerical data as determined by said decision means, thereby producing a correlated result, said control means retrieving said codes indicative of said pause intervals from said pause code storage means and inserting said pause intervals at certain desired locations within the correlated result, the desired locations being dependent upon the particular correlated result, said control means developing output signals of a predetermined sequential order representative of the correlated result inclusive of the inserted pause intervals; and means responsive to the output signals from said control means for developing audible sounds in said predetermined sequential order, said audible sounds representing said numerical data, the digit positions of said numerical data, and the pause intervals inserted at said desired locations therein.

2. A synthetic speech device in accordance with claim 1, wherein the digit positions of the numerical data determined by said decision means include the hundred millions position, the ten thousands position, the hundreds position, and the tens position.

3. A synthetic speech device in accordance with claim 2, wherein the correlated result produced by said control means includes the numerical data associated with a particular digit position followed by its associated digit position information, said control means inserting a said pause interval immediately subsequent to the associated digit position information, the audible sound developing means developing audible sounds, in sequence, representative of the numerical data associated with the particular digit position, its associated digit position information, and the said pause interval.

* * * * *